US011335494B2

(12) United States Patent
Yeo et al.

(10) Patent No.: US 11,335,494 B2
(45) Date of Patent: May 17, 2022

(54) PLANAR TRANSFORMER

(71) Applicants: HYUNDAI MOTOR COMPANY, Seoul (KR); KIA MOTORS CORPORATION, Seoul (KR)

(72) Inventors: In Yong Yeo, Bucheon-si (KR); Tae Jong Ha, Seoul (KR); Dae Woo Lee, Incheon (KR); Youn Sik Lee, Suwon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 496 days.

(21) Appl. No.: 16/510,036

(22) Filed: Jul. 12, 2019

(65) Prior Publication Data

US 2020/0194162 A1 Jun. 18, 2020

(30) Foreign Application Priority Data

Dec. 12, 2018 (KR) ..... 10-2018-0159641

(51) Int. Cl.
*H01F 27/28* (2006.01)
*H01F 27/08* (2006.01)
*H01F 27/24* (2006.01)

(52) U.S. Cl.
CPC ..... *H01F 27/2804* (2013.01); *H01F 27/08* (2013.01); *H01F 27/24* (2013.01); *H01F 2027/2809* (2013.01); *H01F 2027/2819* (2013.01)

(58) Field of Classification Search
None
See application file for complete search history.

(56) References Cited

U.S. PATENT DOCUMENTS 7,187,263 B2 * 3/2007 Vinciarelli ..... H01F 27/2804 336/200
8,339,808 B2 * 12/2012 Nakahori ..... H01F 27/2804 363/17

(Continued)

FOREIGN PATENT DOCUMENTS

KR 10-1992-0015403 8/1992
KR 10-1838223 3/2018
KR 10-1838225 3/2018

*Primary Examiner* — Mang Tin Bik Lian
(74) *Attorney, Agent, or Firm* — Mintz Levin Cohn Ferris Glovsky and Popeo, P.C.; Peter F. Corless

(57) ABSTRACT

A planar transformer is disclosed. The planar transformer includes a first core, a second core, a third core, and a fourth core, which are sequentially disposed; a primary coil unit having multiple primary substrates through which the first to fourth cores penetrate and on which primary coil patterns are formed such that magnetic flux is generated in a first direction in the first and fourth cores and in a second direction in the second and third cores; and a secondary coil unit having multiple secondary substrates through which the first to fourth cores penetrate and on which secondary coil patterns are formed, the secondary coil patterns formed on a periphery of the first to fourth cores such that current induced by the magnetic flux flowing in the first to fourth cores flows therein, wherein the multiple primary and secondary substrates form a multi-layer structure.

8 Claims, 7 Drawing Sheets

(56) References Cited

U.S. PATENT DOCUMENTS

| | | | | |
|---|---|---|---|---|
| 2010/0232181 | A1* | 9/2010 | Nakahori | H01F 27/2804 363/17 |
| 2016/0035481 | A1* | 2/2016 | Hachiya | H05K 1/165 336/61 |
| 2017/0309395 | A1* | 10/2017 | Shiraki | B60L 50/13 |
| 2017/0330678 | A1* | 11/2017 | Harrison | H01F 27/2804 |
| 2017/0345541 | A1* | 11/2017 | Yang | H01F 27/2823 |
| 2018/0226182 | A1* | 8/2018 | Fe | H01F 27/306 |
| 2019/0043660 | A1* | 2/2019 | Jin | H02M 3/155 |

* cited by examiner

PLANAR TRANSFORMER

CROSS REFERENCE TO RELATED APPLICATION

The present application claims priority to and the benefit of Korean Patent Application No. 10-2018-0159641 filed on Dec. 12, 2018, which is incorporated herein by this reference in its entirety.

FIELD

The present disclosure relates to a planar transformer, and more particularly to a planar transformer that may reduce heat generation and losses through a suitable arrangement of cores and a coil pattern structure.

BACKGROUND

The statements in this section merely provide background information related to the present disclosure and may not constitute prior art.

A transformer used for various electrical and electronic circuits is a device for increasing or decreasing an AC voltage using electromagnetic coupling between coils. In response to the demand for a small and lightweight component, a planar transformer, which is implemented by printing the coil of a transformer as a pattern on a planar substrate such as a Printed Circuit Board (PCB), has been developed.

The planar transformer, configured such that a coil formed with wire is implemented as a circuit pattern, reduces the size of a transformer, but is problematic in that the increased current density, which results from a large amount of current flowing in the small volume, increases heat generation. Also, because the coil is implemented in the form of a pattern on a plane, the area occupied by the coil is increased, whereby the height may be reduced but the area may be increased compared to a coil formed with wire.

Accordingly, a technical requirement for a more efficient wiring method for reducing heat generation and a coil area has existed in this technical field.

SUMMARY

The present disclosure provides a planar transformer that may reduce heat generation and losses and reduce the size thereof by optimizing the arrangement of cores and a coil pattern structure.

According to one aspect, there is provided a planar transformer, which includes a first core, a second core, a third core, and a fourth core, which are sequentially disposed; a primary coil unit having multiple primary substrates through which the first to fourth cores penetrate and on which primary coil patterns are formed such that magnetic flux is generated in a first direction in the first core and the fourth core and such that magnetic flux is generated in a second direction in the second core and the third core; and a secondary coil unit having multiple secondary substrates through which the first to fourth cores penetrate and on which secondary coil patterns are formed, the secondary coil patterns being formed on a periphery of the first to fourth cores such that current induced by the magnetic flux flowing in the first to fourth cores flows therein. The multiple primary substrates and the multiple secondary substrates may form a multi-layer structure.

In some forms of the present disclosure, the multiple primary substrates and the multiple secondary substrates may include multiple vias through which the primary coil patterns formed on the different primary substrates are electrically connected with each other and through which the secondary coil patterns formed on the different secondary substrates are electrically connected with each other.

In some forms of the present disclosure, the primary coil pattern may be formed around the second and third cores so as to be common thereto, and no primary coil pattern may be formed between the second core and the third core.

In some forms of the present disclosure, the secondary coil patterns may include a coil pattern formed around each of the first core and the fourth core in the first direction and a coil pattern formed around each of the second core and the third core in the second direction.

In some forms of the present disclosure, the primary coil unit may include a first primary substrate and a second primary substrate, the secondary coil unit may include a first secondary substrate and a second secondary substrate, and the first secondary substrate, the first primary substrate, the second primary substrate, and the second secondary substrate may be sequentially stacked from a bottom. The primary coil patterns formed on the first primary substrate and the second primary substrate may be connected in serial through some of the multiple vias, and the secondary coil patterns formed on the first secondary substrate and the second secondary substrate may be connected in parallel through the remaining vias, among the multiple vias.

In some forms of the present disclosure, the multiple vias may include a first via, a second via, and a third via, which connect the first coil patterns formed on the first primary substrate and the second primary substrate with each other, and a fourth via, a fifth via, a sixth via, and a seventh via, which connect the secondary coil patterns formed on the first secondary substrate and the second secondary substrate with each other.

In some forms of the present disclosure, the first primary substrate may include a first primary coil pattern formed around the first core, a second primary coil pattern formed around the second and third cores, and a third primary coil pattern extended from the second primary coil pattern and formed around the fourth core. Also, the second primary substrate may include a fourth primary coil pattern, a fifth primary coil pattern, and a sixth primary coil pattern, the fourth primary coil pattern being electrically connected with the first primary coil pattern through the first via and formed around the first core in the same direction as the first primary coil pattern, the fifth primary coil pattern being extended from the fourth primary coil pattern, electrically connected with the second primary coil pattern through the second via, and formed around the second and third cores in the same direction as the second primary coil pattern, and the sixth primary coil pattern being electrically connected with the third primary coil pattern through the third via and formed around the fourth core in the same direction as the third primary coil pattern.

In some forms of the present disclosure, the first secondary substrate may include a first secondary coil pattern electrically connected with the fifth via and formed around the first core, a second secondary coil pattern electrically connected with the fifth via and formed around the second core in a direction opposite the direction in which the first secondary coil pattern is formed, a third secondary coil pattern electrically connected with the fifth via and formed around the third core in the direction opposite the direction in which the first secondary coil pattern is formed, and a fourth secondary coil pattern electrically connected with the fifth via and formed around the fourth core in the same direction as the first secondary coil pattern.

In some forms of the present disclosure, the fourth via, the sixth via, and the seventh via may be electrically connected with each other, and the second secondary substrate may include a fifth secondary coil pattern, a sixth secondary coil pattern, a seventh secondary coil pattern, and an eighth secondary coil pattern, the fifth secondary coil pattern being electrically connected with the fifth via, electrically connected with the first secondary coil pattern through the fourth via, and formed around the first core in the same direction as the first secondary coil pattern, the sixth secondary coil pattern being electrically connected with the fifth via, electrically connected with the second secondary coil pattern through the sixth via, and formed around the second core in the same direction as the second secondary coil pattern, the seventh secondary coil pattern being electrically connected with the fifth via, electrically connected with the third secondary coil pattern through the seventh via, and formed around the third core in the same direction as the third secondary coil pattern, and the eighth secondary coil pattern being electrically connected with the fifth via, electrically connected with the fourth secondary coil pattern through the seventh via, and formed around the fourth core in the same direction as the fourth secondary coil pattern.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
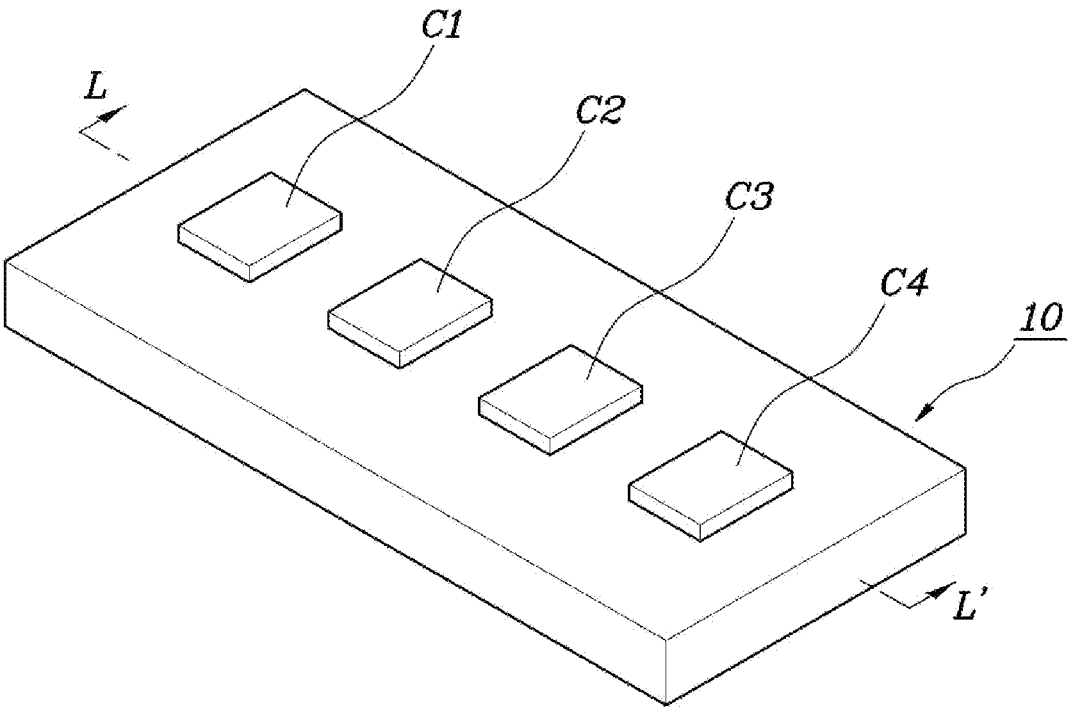
FIG. 1 is a perspective view of a planar transformer in one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Hereinbelow, a planar transformer according to forms of the present disclosure will be described in detail with reference to the accompanying drawings.

Figure 2:
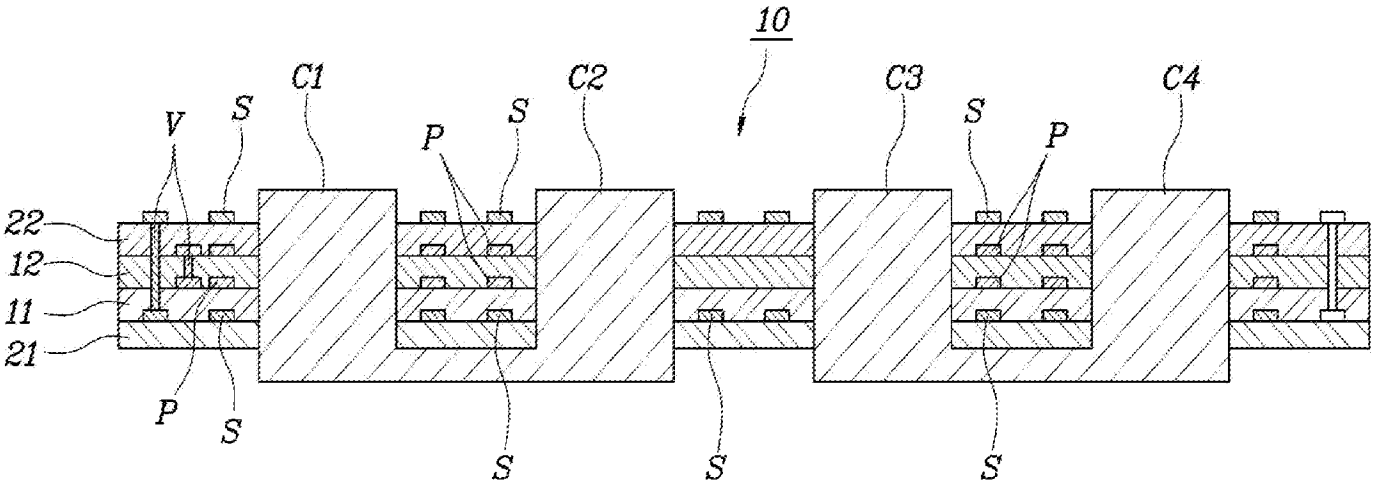
FIG. 2 is a cross-sectional view of the planar transformer in FIG. 1 in one form of the present disclosure, which is taken along the line L-L'.

FIG. 1 is a perspective view of a planar transformer according to an form of the present disclosure, and FIG. 2 is a cross-sectional view of the planar transformer in FIG. 1 in some forms of the present disclosure, which is taken along the line L-L'.

The planar transformer in some forms of the present disclosure may include a first core C1, a second core C2, a third core C3, and a fourth core C4, which are sequentially disposed, and multiple coil units. The multiple coil units include multiple coil patterns P and S around the first to fourth cores C1 to C4 and multiple substrates 11, 12, 21 and 22 through which the first to fourth cores C1 to C4 penetrate and on which the multiple coil patterns P and S are formed.

The multiple cores C1 to C4 are components for generating magnetic flux when current flows in the primary coil pattern P of the transformer, among the coil patterns around the cores, and may be connected in a U shape in the lower part of the transformer 10. For example, the first core C1 and the second core C2 are connected with each other in the lower part of the transformer, whereby magnetic flux flowing in the first core C1 and magnetic flux flowing in the second core C2 may be formed in opposite directions in the vicinity of the coil pattern. Similarly, the third core C3 and the fourth core C4 are connected with each other in the lower part of the transformer, whereby magnetic flux flowing in the third core C3 and magnetic flux flowing in the fourth core C4 may be formed in opposite directions in the vicinity of the coil pattern.

In some forms of the present disclosure, a primary coil pattern, corresponding to the primary coil of the transformer, may be formed such that magnetic flux is formed in the same direction in the first core C1 and the fourth core C4, which are disposed in the opposite ends of the structure in which cores are sequentially disposed, and such that, in the second core C2 and the third core C3, magnetic flux is formed in a direction opposite the direction of the magnetic flux of the first core C1. Accordingly, the path of the coil pattern implemented in a planar form may be optimized, whereby heat generation may be reduced and the size of the transformer may be reduced.

The primary coil unit may include primary substrates 11 and 12 and primary coil patterns P formed on the surfaces of the primary substrates 11 and 12. The secondary coil unit may include secondary substrates 21 and 22 and secondary coil patterns S formed on the surface of the secondary substrates 21 and 22. The primary and secondary substrates 11, 12, 21 and 22, the primary coil patterns, and the secondary coil patterns may be implemented in the form of a Printed Circuit Board (PCB). That is, a coil unit may be configured by forming a pattern with a conductive material on a substrate made of an insulation material.

The primary substrate of each of the multiple primary coil units may include a via V, and the primary coil patterns P of different primary coil units may be electrically connected with each other through the via V. Similarly, the second substrate of each of the multiple secondary coil units may include a via V, and the secondary coil patterns S of different secondary coil units may be electrically connected with each other through the via V.

Particularly, in some forms of the present disclosure, the primary coil pattern P may be formed around the two cores C2 and C3, which are disposed on the inward side, among the sequentially disposed four cores C1, C2, C3 and C4. That is, no primary coil pattern P may be formed between the two cores C2 and C3. Accordingly, the primary coil pattern P around the two cores C2 and C3 causes magnetic flux to be formed in the same direction in each of the two cores C2 and C3 without forming a pattern therebetween. Accordingly, the length of the pattern may be reduced and the heat generation may be reduced, whereby the effect of reducing losses may be achieved. Also, a cooler on the outer surface of the transformer 10 may be omitted at the position corresponding to the space between the two cores C2 and C3.

The characteristics of the planar transformer in some forms of the present disclosure may be more clearly understood through a specific application.

Figure 3:
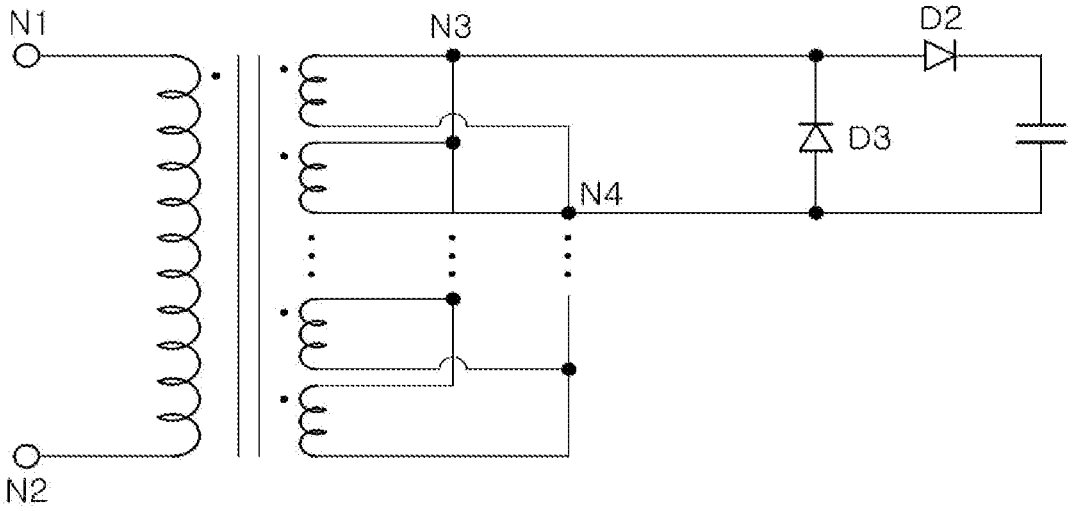
FIG. 3 is a circuit diagram that shows an example of a transformer implemented as a planar transformer in one form of the present disclosure.

FIG. 3 is a circuit diagram that shows an example of a transformer implemented as a planar transformer in some forms of the present disclosure, and FIGS. 4 to 7 are top plan views that show the coil units of the respective layers of a planar transformer according to an form of the present disclosure, which implement the circuit structure shown in FIG. 3.

The circuit diagram of FIG. 3 shows a transformer in which a primary coil unit includes a single primary coil having eight turns and a secondary coil unit includes eight secondary coils, each having a single turn. The respective secondary coils may be connected with a diode D1 in parallel.

The transformer having the above circuit structure may be formed in a multi-layer structure in which two primary coil units and two secondary coil units, shown in FIGS. 4 to 7, are stacked. In this case, the first secondary coil unit shown in FIG. 4, the first primary coil unit shown in FIG. 5, the second primary coil unit shown in FIG. 6, and the second secondary coil unit shown in FIG. 7 may be sequentially stacked from the bottom. For reference, FIGS. 4 to 7 show only coil patterns, cores, and vias, and substrates 11, 12, 21 and 22 are not illustrated.

The primary coil will be described first with reference to FIGS. 5 and 6, which show the primary coil unit for configuring the primary coil of the transformer 10 having a multi-layer structure.

Figure 5:
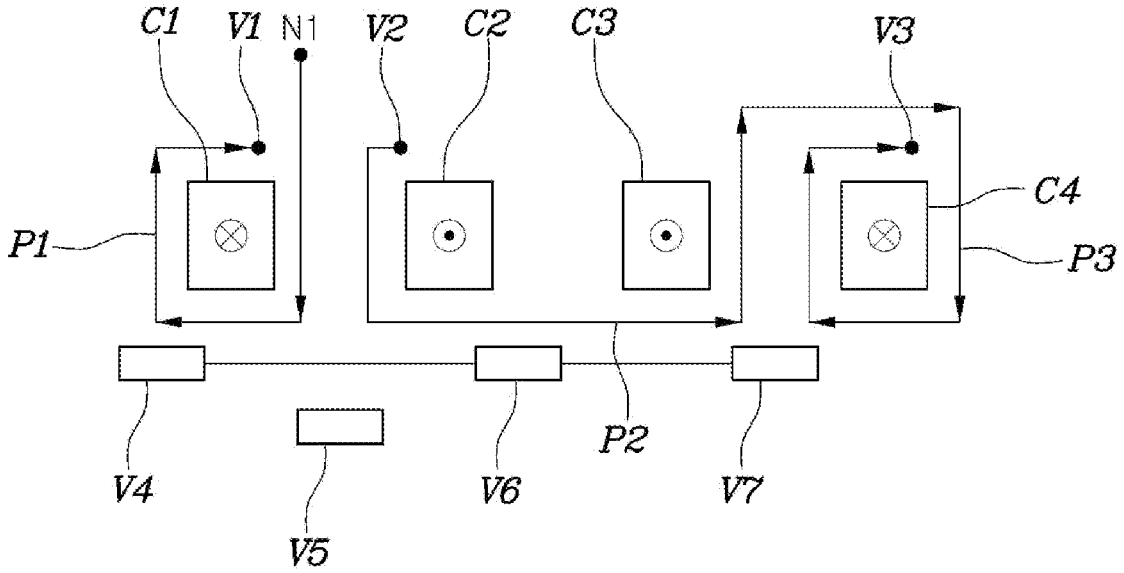

Referring to FIG. 5, the first primary coil unit, which configures the second layer of the transformer 10 having a multi-layer structure, includes a first primary coil pattern P1 formed around the first core C1 in a first direction (a clockwise direction), a second primary coil pattern P2 formed around the second and third cores C2 and C3 in a second direction (a counterclockwise direction), and a third primary coil pattern P3 formed around the fourth core C4 in the first direction.

Figure 6:
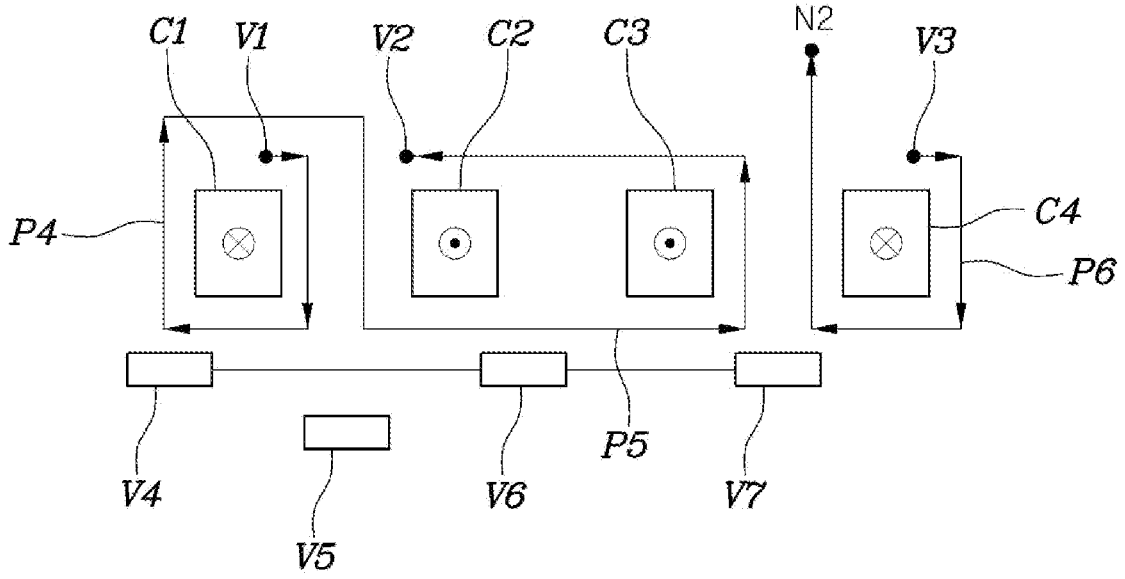

Also, referring to FIG. 6, the second primary coil unit, which configures the third layer of the transformer 10 having a multi-layer structure, includes a fourth primary coil pattern P4 formed around the first core C1 in the first direction, a fifth primary coil pattern P5 formed around the second and third cores C2 and C3 in the second direction, and a sixth primary coil pattern P6 formed around the fourth core C4 in the first direction.

The first primary coil pattern P1 and the fourth primary coil pattern P4 may be electrically connected with each other through a first via V1, the second primary coil pattern P2 and the fifth primary coil pattern P5 may be electrically connected with each other through a second via V2, and the third primary coil pattern P3 and the sixth primary coil pattern P6 may be electrically connected with each other through a third via V3.

The first to third vias V1 to V3 may be suitably selected depending on the arrangement of the primary coil patterns P1 to P6.

In FIGS. 5 and 6, the second primary coil pattern P2 and the fifth primary coil pattern P5 are formed around both the second core C2 and the third core C3 so as to be common thereto, and no primary coil pattern is formed between the second core C2 and the third core C3. Through this structure, the effect of two turns that individually surround the second core C2 and the third core C3 may be implemented using a single turn structure surrounding them together. That is, the physical coil structure shown in FIGS. 5 and 6 has a total of six turns, but magnetic flux corresponding to eight turns, each individually surrounding each core, may be formed.

For reference, 'N1' shown in FIG. 5 indicates the position of a node N1, which is the first terminal of the primary coil shown in FIG. 3, and 'N2' indicates the position of a node N2, which is the second terminal of the primary coil shown in FIG. 3.

Figure 4:
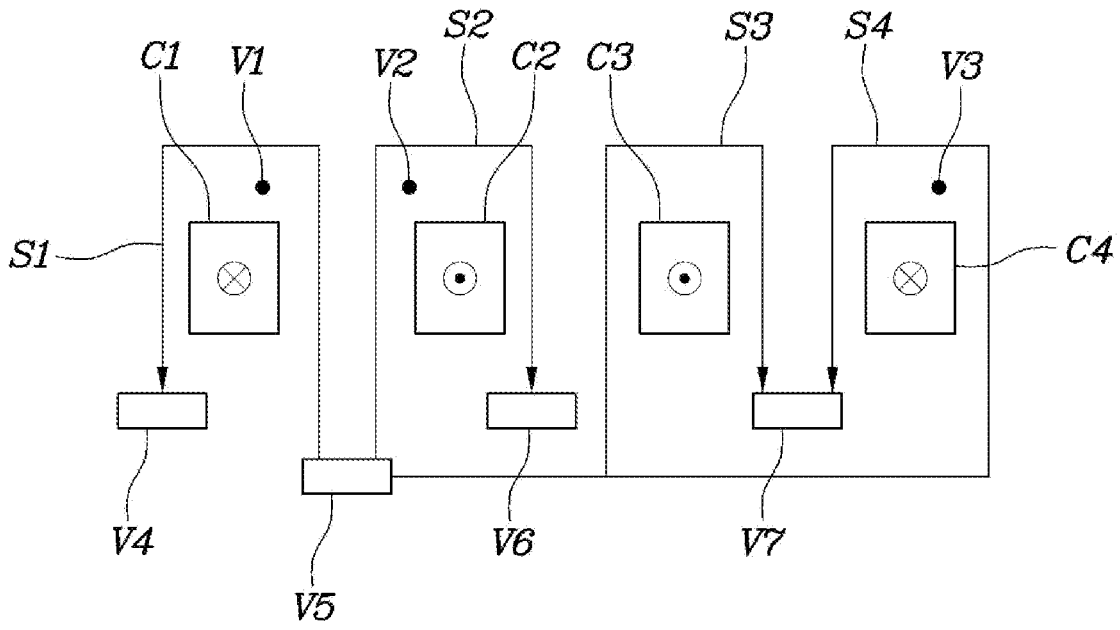
FIGS. 4 to 7 are top plan views that show the coil units of the respective layers of a planar transformer in one form of the present disclosure, which implement the circuit structure shown in FIG. 3.

Next, the first secondary coil unit, which configures the bottom layer of the transformer 10, may include a first secondary coil pattern S1 formed around the first core C1 in the second direction (the counterclockwise direction), a second secondary coil pattern S2 formed around the second core C2 in the first direction, which is opposite the direction of the first secondary coil pattern S1, a third secondary coil pattern S3 formed around the third core C3 in the first direction, and a fourth secondary coil pattern S4 formed around the fourth core C4 in the second direction, as shown in FIG. 4.

The first terminals of the first to fourth secondary coil patterns S1 to S4 are electrically connected with a fifth via V5 through a pattern formed on the first secondary substrate. Also, the second terminal of the first secondary coil pattern S1 may be connected with a fourth via V4, the second terminal of the second secondary coil pattern S2 may be connected with a sixth via V6, and the second terminals of the third secondary coil pattern S3 and the fourth secondary coil pattern S4 may be connected with a seventh via V7. The fourth via V4 may be formed at the point at which the first secondary coil pattern S1 ends, the sixth via V6 may be formed at the point at which the second secondary coil pattern S2 ends, and the seventh via V7 may be formed at the point at which the third and fourth secondary coil patterns S3 and S4 end.

Figure 7:
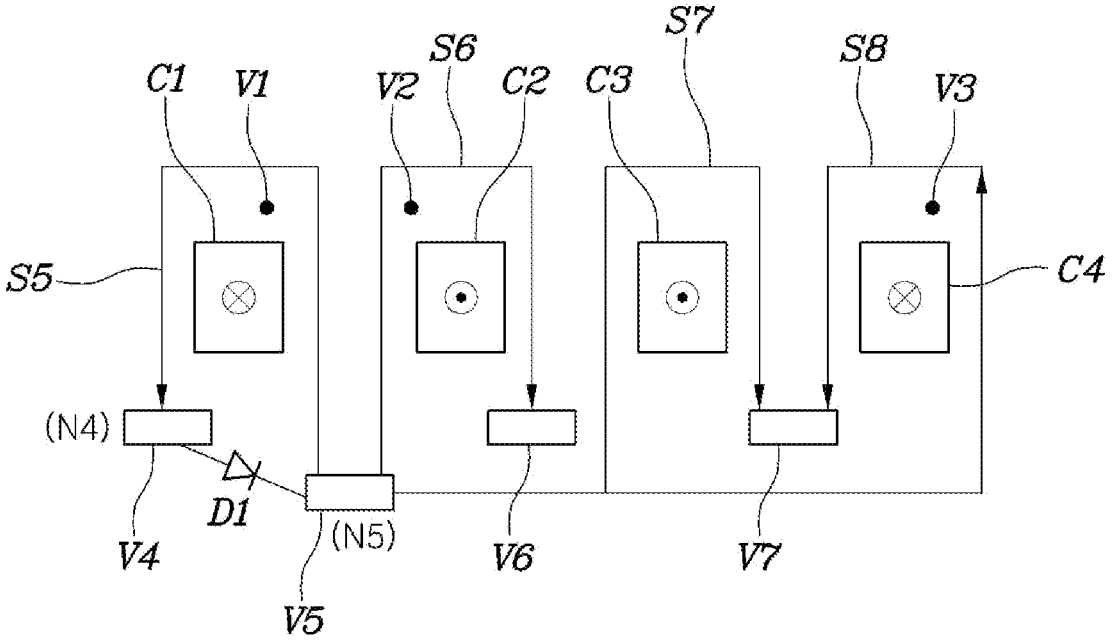

Referring to FIG. 7, similar to the first secondary coil unit shown in FIG. 4, the second secondary coil unit, which configures the top layer of the transformer 10, may include a fifth secondary coil pattern S5 formed around the first core C1 in the second direction, a sixth secondary coil pattern S6 formed around the second core C2 in the first direction, a seventh secondary coil pattern S7 formed around the third core C3 in the first direction, and an eighth secondary coil pattern S8 formed around the fourth core C4 in the second direction.

The fifth via V5 may correspond to a node N3, which corresponds to the cathode of the diode D1 to which the first terminals of the secondary coils of the transformer shown in FIG. 3 are connected in common. The fourth via V4, the sixth via V6, and the seventh via V7 may be electrically connected with each other through a connection pattern on the substrate on which the first or second primary coil unit including the primary coil pattern is formed. The fourth via V4, the sixth via V6, and the seventh via V7, electrically connected with each other, may correspond to a node N4, which corresponds to the anode of the diode D1 to which the second terminals of the secondary coils of the transformer shown in FIG. 3 are connected in common.

Like the pattern structures shown in FIGS. 4 to 7, some forms of the present disclosure may be configured such that some of the primary coil patterns are formed around multiple cores so as to be common thereto, whereby the length of the pattern may be reduced. The reduction of the pattern length may result in not only reduction of losses and heat generation but also a decrease in the size of the transformer.

Also, because a pattern may be omitted between multiple cores around which a common coil pattern is formed, heat generation is reduced therebetween, and a cooler outside the transformer may be omitted at the corresponding position. Accordingly, the effect of cost reduction may be achieved, and a layout may be easily adjusted when other components are arranged.

According to the above-described planar transformer, some of primary coil patterns are formed around multiple cores so as to be common thereto, whereby the length of the pattern may be reduced. Accordingly, the losses of the transformer and heat generation may be reduced, and the size of the transformer may also be reduced.

Also, according to the above-described planar transformer, because a pattern may be omitted between multiple cores around which a common coil pattern is formed, heat generation may be reduced therebetween, and a cooler outside the transformer may be omitted at the corresponding position, whereby the effect of cost reduction may be achieved, and a layout may be easily adjusted when other components are arranged.

Effects obtainable from the present disclosure are not limited by the above-mentioned effects, and other unmentioned effects can be clearly understood from the foregoing description by those having ordinary skill in the technical field to which the present disclosure pertains.

The description of the disclosure is merely exemplary in nature and, thus, variations that do not depart form the substance of the disclosure are intended to be within the scope of the disclosure. Such variations are not to be regarded as a departure from the spirit and scope of the disclosure.

What is claimed is:

1. A planar transformer comprising:

a first core, a second core, a third core, and a fourth core, which are sequentially disposed;

a primary coil unit having a plurality of primary substrates through which the first core, the second core, the third core, and the fourth core penetrate and on which primary coil patterns are formed such that a magnetic flux is generated in a first direction in the first core and the fourth core and in a second direction in the second core and the third core; and a secondary coil unit having a plurality of secondary substrates through which the first core, the second core, the third core, and the fourth core penetrate and on which secondary coil patterns are formed, wherein the secondary coil patterns are formed on a periphery of the first core to the fourth core such that current induced by the magnetic flux flowing in the first core to the fourth core flows therein, wherein the plurality of primary substrates and the plurality of secondary substrates form a multi-layer structure.

2. The planar transformer of claim 1, wherein the plurality of primary substrates and the plurality of secondary substrates comprises:

a plurality of vias configured to:

connect electrically the primary coil patterns that are formed on the different primary substrates; and connect electrically the secondary coil patterns that are formed on the different secondary substrates.

3. The planar transformer of claim 1, wherein the primary coil pattern is:

formed around the second core and the third core; and not formed between the second core and the third core.

4. The planar transformer of claim 1, wherein the secondary coil patterns comprise:

a coil pattern formed around each of the first core and the fourth core in the first direction; and a coil pattern formed around each of the second core and the third core in the second direction.

5. The planar transformer of claim 2, wherein:

the primary coil unit comprises a first primary substrate and a second primary substrate, the secondary coil unit comprises a first secondary substrate and a second secondary substrate, the first secondary substrate, the first primary substrate, the second primary substrate, and the second secondary substrate are sequentially stacked from a bottom, the primary coil patterns formed on the first primary substrate and the second primary substrate are connected in serial through at least one via of the plurality of vias, and the secondary coil patterns formed on the first secondary substrate and the second secondary substrate are connected in parallel through remaining vias of the plurality of vias.

6. The planar transformer of claim 5, wherein the plurality of vias comprises:

a first via, a second via, and a third via that are configured to connect the first coil patterns formed on the first primary substrate and the first coil patterns formed on the second primary substrate; and a fourth via, a fifth via, a sixth via, and a seventh via that are configured to connect the secondary coil patterns formed on the first secondary substrate and the secondary coil patterns formed on the second secondary substrate.

7. The planar transformer of claim 6, wherein:

the first primary substrate comprises:

a first primary coil pattern formed around the first core;

a second primary coil pattern formed around the second and third cores; and a third primary coil pattern extended from the second primary coil pattern and formed around the fourth core, and the second primary substrate comprises:

a fourth primary coil pattern electrically connected with the first primary coil pattern through the first via and formed around the first core in a same direction as the first primary coil pattern;

a fifth primary coil pattern extended from the fourth primary coil pattern, wherein the fifth primary coil pattern is electrically connected with the second primary coil pattern through the second via and formed around the second and third cores in a same direction as the second primary coil pattern; and a sixth primary coil pattern electrically connected with the third primary coil pattern through the third via and formed around the fourth core in a same direction as the third primary coil pattern.

8. The planar transformer of claim 6, wherein:

the fourth via, the sixth via, and the seventh via are electrically connected with one another, the first secondary substrate comprises:

a first secondary coil pattern electrically connected with the fifth via and formed around the first core;

a second secondary coil pattern electrically connected with the fifth via and formed around the second core in a direction opposite the direction in which the first secondary coil pattern is formed;

a third secondary coil pattern electrically connected with the fifth via and formed around the third core in the direction opposite the direction in which the first secondary coil pattern is formed; and a fourth secondary coil pattern electrically connected with the fifth via and formed around the fourth core in a same direction as the first secondary coil pattern, and the second secondary substrate comprises:

a fifth secondary coil pattern electrically connected with the fifth via and the first secondary coil pattern through the fourth via, wherein the fifth secondary coil pattern is formed around the first core in the same direction as the first secondary coil pattern;

a sixth secondary coil pattern electrically connected with the fifth via and the second secondary coil pattern through the sixth via, wherein the sixth secondary coil pattern is formed around the second core in a same direction as the second secondary coil pattern;

a seventh secondary coil pattern electrically connected with the fifth via and the third secondary coil pattern through the seventh via, wherein the seventh secondary coil pattern is formed around the third core in a same direction as the third secondary coil pattern; and an eighth secondary coil pattern electrically connected with the fifth via and the fourth secondary coil pattern through the seventh via, wherein the eighth secondary coil pattern is formed around the fourth core in a same direction as the fourth secondary coil pattern.

* * * * *